US008807600B2

(12) United States Patent
Hanson

(10) Patent No.: US 8,807,600 B2
(45) Date of Patent: Aug. 19, 2014

(54) VERSATILE LABEL

(76) Inventor: Carlyle Hanson, Brooklyn, NY (US)

( * ) Notice: Subject to any disclaimer, the term of this patent is extended or adjusted under 35 U.S.C. 154(b) by 11 days.

(21) Appl. No.: 13/396,506

(22) Filed: Feb. 14, 2012

(65) Prior Publication Data

US 2012/0205906 A1 Aug. 16, 2012

Related U.S. Application Data

(60) Provisional application No. 61/443,228, filed on Feb. 15, 2011.

(51) Int. Cl.
*G09F 9/00* (2006.01)
*G09F 3/18* (2006.01)

(52) U.S. Cl.
USPC ..... 283/74; 116/321; 116/324; 40/661.04

(58) Field of Classification Search
CPC ..... G09F 9/37; G09F 9/40
USPC ..... 116/321, 322, 324; 283/74; 40/661.04
See application file for complete search history.

(56) References Cited

U.S. PATENT DOCUMENTS 2,871,485 A * 2/1959 Greco ..... 40/661.04
5,305,706 A * 4/1994 Arjomand ..... 116/321

* cited by examiner

*Primary Examiner* — Kyle Grabowski
(74) *Attorney, Agent, or Firm* — Alexey Bakman, Esq.

(57) ABSTRACT

A versatile label of the present invention comprises at least one label body. Each label body comprises at least one identifier set, with each identifier set comprising a plurality of identifier markers. The plurality of identifier markers is positioned on the face side of the label body. The label body further comprises at least one selection indicator.

14 Claims, 3 Drawing Sheets

VERSATILE LABEL

This application claims priority to provisional application No. 61/443,228, filed on Feb. 15, 2011.

FIELD OF THE INVENTION

The field of this invention is labels, and more particularly a versatile label, usable on objects of clothing and adjustable to designate one or more of several alternative identifier markers, indicated on the label.

BACKGROUND OF THE INVENTION

In the course of the last several centuries, the trend in clothing has been moving away from personalized custom-made articles to mass-produced, standardized products. Instead of products being designed and fitted to a particular consumer, consumers now have to choose from pre-manufactured products that happen to fit them. In order to simplify this selection process, a labeling system has been developed in the clothing industry. This labeling system somewhat standardizes and facilitates the fitting process. Thus, clothing items like T-shirts are usually identified by standard designations such as S, M, L, XL, etc. Other items are designated by more than one identifier. For example, shoes may be identified by the length, as well as the width. The pants are commonly identified by the waist size, the length, and sometimes the fit.

Various mass-produced items other than clothing are also identified by several pre-set characteristics. For example, a customizable table top sold in a store like IKEA (the name IKEA is a trademark of INGKA Holding B.V. and Interogo Foundation) may be available in several sizes, with varying length, width, thickness and color. Chicken eggs sold by a farmer may be sorted according to such identifiers as the size (S, M, L), yolk firmness (A, AA, AAA), freshness, color, etc.

The clothing and product labels were designed with the purpose of assisting the consumer in finding the right product. Traditionally, a consumer would know whether he/she wears large or small apparels or buys AA or A-grade eggs. Once the consumer would locate one or more products with the appropriate label, the consumer would try on, or visually inspect the product to gauge whether this particular size or class meets his or her requirements. That is, the consumer would be guided to the right product by the tag, but would ultimately select it based on the hands-on personal selection and inspection. The consumers would know that sizing on certain items runs smaller or larger than they expect, and requires additional inspection. Such an approach worked well when most products were selected by consumers in stores. However, with the onset of the Internet age, more and more products are now being sold and purchased online. More and more customers are ordering products online, from clothing, to electronics, to groceries. These are that products that consumers have no opportunity to try on, handle or even personally see before buying.

The development on internet shopping has put new pressures on manufacturers of the products sold online, and particularly clothing manufacturers. Now, more than ever before, the customers have to rely on standardized identification and description of products provided by the manufacturers and copied verbatim by the retailers. And that is why an increasing number of government regulations are being set in place to assure extensive disclosure of product's characteristics on labels. In the US, the Federal Trade Commission already imposes a number of regulations on labeling, requiring extensive disclosure by the manufacturer. Even greater label disclosure requirements are expected in the future. Such disclosure requirements naturally require a greater number of labels, with greater number of information fields.

There are also commercial pressures. If items' identification/description is not accurate, the customer will be disappointed with the store and the brand. The customer will also ship back and return the items, imposing considerable additional costs on retailers and manufacturers (who often pay for shipping and to whom the items are eventually returned). So, there is a considerable incentive and pressure on retailers to describe the products, and particularly items of clothing, as accurately as possible, with as many details/characteristics as possible.

For example, since the consumer can not try on a pair of pants, he/she need to be informed of not only the waist width, and inseam length of the pant, but also preferably the fit, the number of threads, the exact color (since monitors do not always display color correctly), as well as other characteristics. For the retailer to reveal as many of the garment's characteristics as possible, such characteristics must be provided by the manufacturer. Since clothing frequently comes without individual packaging, becomes separated from packaging, and since retailers usually order a great number of sizes/variations of the same item of apparel in the same container, such information is usually and most conveniently provided by labels, attached to each individual piece of clothing.

The more characteristics the manufacturers have to reveal, the more individual labels they have to attach to clothing. The reason that several tags have to be attached is that individual characteristics vary in the batch of manufactured clothing items of the same design. For example, some of the pants of the same design will have a waist of 30, others waist 32, yet others waist 34, and so one. Some of the pants with waist 30 will have a length of 30, others will have the length of 32, 34, etc. Some will have a slightly different fit. The pants may be of same style, but different color. Different color may require different washing and care instructions. With all the different characteristics in a batch of pants, there is a tremendous number of permutations possible, all of which have to be indicated on the labels.

The more labels the manufacturer has to put on the item, the more expensive the item becomes. Labels themselves are expensive. Attaching each label takes time, labor and expense. Multiple labels may also destroy the aesthetic appeal of the article of clothing, or make it uncomfortable to wear. Also, the manufacturer can not always predict the exact demand for each variation of the design. Therefore, the manufacturer may be left with too many labels he or she does not need, and run out of the proper ones. In the latter situation, even if the manufacturer can manufacture an item to keep up with demand, he or she will not be able to ship the item until more tags are ordered and attached. The unneeded extra tags will have to be discarded, becoming a waste of money and a burden to the environment.

Manufacturers may elect to manufacture and attach a single label with all the information onto each piece of clothing. However, such approach requires the design and manufacture of a great variety of labels—one type of label for each permutation of the article produced. For example, in a batch where there are only four labeling characteristics, including 15 waist sizes, 10 length sizes, 4 fit types and 3 colors, the manufacturer faces 1,800 labeling possibilities. This means that if the manufacturer is only attaching one label to each pair of pants, he or she will have to order and pay for almost two thousand varieties of labels, some of which will be required in much greater quantities than others.

The design and manufacture of such great variety labels is expensive. Sorting and attaching the proper label to the proper variety is time-consuming and fraught with errors. While the use of such labels may be feasible in large-scale productions, where tens of thousands of articles with each permutation are produced, it is not economically practical if a relatively small number of each design permutation is manufactured. In such a small production run, only a small number of each type of labels will be produced, but the manufacturer must pay separately for design and printing/production of every label permutation. This is extremely expensive and inefficient for small-to-medium scale clothing manufacture.

Furthermore, the attachment of traditional labels is often inconsistent with the article design. Some clothing lines do not have the traditional inseams, into which the labels can be sewn. Other garments feature unusual and revolutionary design, where traditional labels with small standard text just visually destroy the novelty and uniqueness of the article, thus reducing the manufacturer's sales and profits.

Therefore, there is a long-felt and unmet need in the art for a universal customizable label that can be applied to a variety of similar products, and adapted to reflect one or more individual characteristics of each particular variety. Such label must be inexpensive to produce, easy to customize, provide potentially numerous customization options, be easy to attach, and aesthetically pleasing. The label of the present invention meets all of these requirements and provides numerous additional benefits.

SUMMARY OF THE PRESENT INVENTION

The present invention is defined by the following claims and nothing in this section should be taken as a limitation on those claims.

The invention describes and claims a versatile label that comprises at least one label body (and possibly a plurality of label bodies). Each label body comprises at least one identifier set, with each identifier set comprising a plurality of identifier markers. The plurality of identifier markers is positioned on the face side of the label body. In some embodiments, identifier markers are stitched onto the face side of the label body. The label body further comprises at least one selection indicator.

In the preferred embodiments, the selection indicator is a sliding selection indicator, slidingly attached to the label body. Such attachment allows for movement along the label body length and for selection of the identifier marker or markers. Some types of the selection indicators described and claimed comprise a window. The window is positioned over the face side of the label body and sized to allow at least one of the identifier markers to completely show through the window.

In the preferred variants shown, at least some of the identifier markers identify the size of a garment. In such variants, the label body may be made out of cloth, although the use of other possible materials is described. Certain types of label bodies are described, wherein at least some of the identifier markers identify individual letters of the alphabet.

The description discloses ways of fixably attaching the selection indicator to the label body, including the method involving the use of heat-sensitive glue.

The method of labeling an article of clothing, involving the versatile label of the present invention is also described and claimed.

DETAILED DESCRIPTION OF THE PREFERRED EMBODIMENTS

Figure 1:
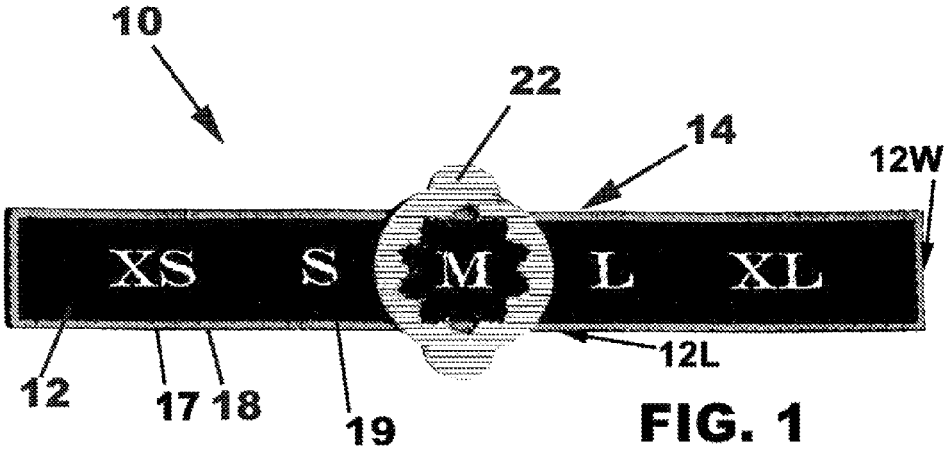
FIG. 1 depicts a view from above, showing the face side of one of the preferred embodiments of the present invention, showing the versatile label of the present invention comprising one identifier set and one selection indicator.

The device of the present invention will now be illustrated by reference to the accompanying drawings. Preferred embodiments of the versatile label of the present invention have been assigned reference numeral 10. Other elements have been assigned the reference numerals referred to below. The versatile label 10 is also referred to as label 10 below.

In the preferred embodiments of the invention, including the embodiments portrayed on FIGS. 1-4, the label 10 is a device of the type adapted for attachment to clothing articles and for displaying the size of such clothing articles. However, it must be mentioned that the present invention anticipates that the label 10 may be used on products other than articles of clothing and may be used to display various identifier markers, other than clothing sizes. For example, as described above, the farmers may attach such labels to the egg cartons to indicate the characteristics of each particular dozen. In another example, parents may use such labels to "dial in" children's initials on their clothing.

The preferred embodiments of the device of the present invention, illustrated on FIGS. 1-4, the versatile label comprises at least one (and preferably one) label body 12, also referred to as the body 12. Preferably, such label body 12 is flat and thin. In the embodiments depicted, the body 12 is the largest part of the label 10 and is designed for attachment to an article of clothing. In these preferred embodiments, the body 12 is made out of a thin strip of cloth, approximately 1 mm in thickness. It must be noted that in other embodiments, the body 12 may be made of materials other than cloth, such as paper, flexible plastic, tyvek, rubber and can be made thinner or thicker than the preferred embodiments, depending on the type of the product to be labeled. For example, a pair of panties or a light t-shirt would most benefit from a thin flexible label 10 made of cloth, while a thicker rubber or plastic label may be more appropriate for rubber boots or a heavy rain coat. Preferably, the label body 12 is made out of flexible materials, especially if intended for use in clothing. However, the label body may be rigid for labeling other objects.

In the embodiments where the at least one label body is made out of cloth, the label may comprise and be saturated or coated with additional materials, such as glues, lacquers and resins to provide certain attachment options, wear and tear protection, or other required characteristics to the cloth material.

Each label body 12 comprises a label body width 12W (referred to as width 12W), a label body length 12L, referred to as (length 12L) and a label body thickness 12T (thickness 12T). The width 12W, indicated on FIG. 1 refers to the top to bottom measurement, when the label is laid out, face up, on the flat surface. The length 12L refers to the left to right measurement, when the label 10 is laid out, face up on the flat surface. The thickness 12T is the thickness of material between the face side and the back side of the label body 12. Preferably, the label body thickness 12T is less (and preferably much less) than ½ of the label body width 12L. As shown in the accompanying illustrations, the length 12L is preferably greater than the width 12W.

Figure 2:
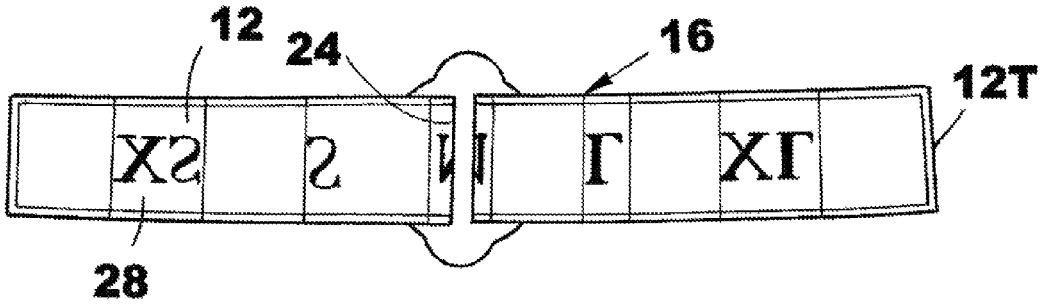
FIG. 2 depicts a view from below, showing the back side of the embodiment of FIG. 1.
Figure 4:
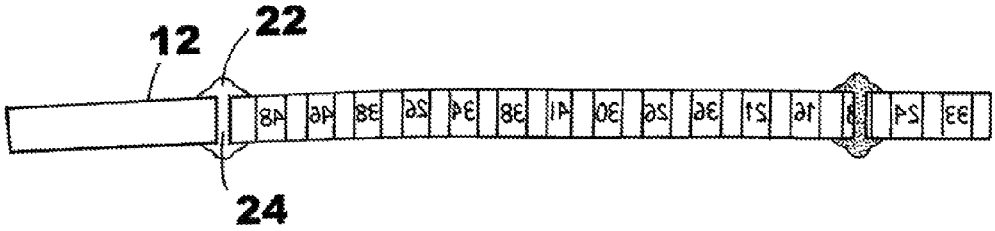
FIG. 4 depicts a view from below, showing the back side of the embodiment of FIG. 3.

The face side 14 generally refers to the viewer-facing, finished side of the label body 12. The face side 14 is intended to be visible and legible to the intended user of the labeled product. This is the side, bearing legible image of identifier markers, as discussed below. The back side 16 is intended for attachment to an article of clothing (or any other product to be labeled). As explained in more detail below, in the preferred embodiment, the back side 16 may bear a layer of glue (preferred), velcro, or other means of attachment to an article of clothing (or to another product). The back side 16 is illustrated in FIGS. 2 and 4.

The label body 12 further comprises a perimeter edge 17, with an edge stitch line 18 running along the perimeter edge 17 in the preferred embodiments. The purpose of the line is to prevent the body 12, particularly in the embodiments where the body 12 is made of cloth, from flaying. Such a line may also be used for aesthetic appeal. In some embodiments the edge stitch line 18 may be the same color as an article of clothing (or another product) to provide better aesthetical transition between the color of the label and the color of the clothing. The edge stitch line 18 is preferably applied to the face side 14 and may penetrate through the back side 16. In some embodiments where the body 12 comprises several stacked layers of material, the edge stitch line 18 may be used to keep the layers attached to one another.

In the preferred variants, the perimeter edge 17 is rectangular, as shown in FIGS. 1-4. Although in other variants, the perimeter edge 17 may be rounded or have another shape consistent with the product or the style of the garment. In the preferred variants shown, the versatile label 10 has the shape of a rectangular strip, preferably a thin strip.

Similarly, the body 12 will vary in length and width from one article to another. For example, bigger heavier articles of clothing may require bigger labels. The labels in FIGS. 1-4 are intended for labeling pants, such as jeans. The sizes of the illustrated embodiments are approximately 5 inches in length for the embodiment of FIGS. 1-2 and approximately 10 inches in length for the embodiment of FIGS. 3-4. However, other, bigger or smaller sizes, as long as they are visible and capable of attachment to a particular product, will work.

The label body 12 comprises at least one identifier set 19, preferably on the face side of the label body. The term identifier set 19, as used here and in the claims refers to a set of symbols or values, identifying at least one characteristic of the product. For example, FIG. 1 portrays one identifier set—the set of garment size measurements.

Each identifier set comprises a plurality of identifier markers 20 (markers 20) positioned on the face side 14 of the label body 12. Thus, the identifier set 19 of FIG. 1 comprises and illustrates a plurality of (5) markers 20 that may be used to identify size of a garment. These markers 20 are: XS, S, M, L, XL. In the preferred embodiments shown, the markers 20 are stitched onto the face side 14 of the body 12. In other embodiments, markers 20 may be printed, glued or otherwise applied onto the face side 14. In some embodiments, the markers 20 may even be comprised of marks created by making cut-outs of the label body 12.

Figure 3:
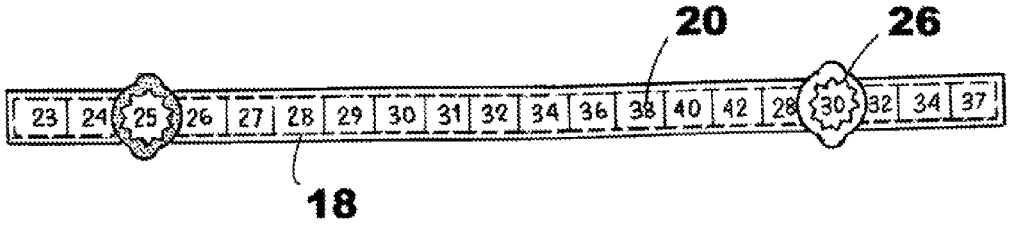
FIG. 3 depicts a view from above of the face side of another one of the preferred embodiments of the present invention, showing the versatile label of the present invention that comprises two identifier sets and two selection indicators.

There may be more than one identifier set 19 in the preferred embodiments of the label 1. FIGS. 3 and 4 illustrate an embodiment where the at least one identifier set 19 is a plurality of identifier sets 19. The embodiment of FIGS. 3-4 shows two identifier sets 19 for two different characteristics of the product. In FIG. 3, the identifier set on the left side of the drawing (consisting of numbers 23-42) comprises markers 20, identifying the waist measurement of the pants. The identifier set on the right of the drawing (consisting of markers 28-37) is presented in different color and identifies the inseam length of the pants.

Yet other embodiments may comprise more than two identifier sets 19. As stated above, another embodiment of the label 10 intended for jeans may also comprise a third identifier set 19 of markers 20 for the fit of the pants, such as "skinny fit", "straight", "flare," "trouser fit," bootcut," etc. In some embodiments, even a fourth identifier set 19, for color, or a fifth one, indicating washing instructions, may be added. Depending on the embodiment and the type of the article to be labeled, there may be any number of identifier sets 19 on a particular label 10. These identifier sets 19 may be added in a continuous line, such as shown with the two sets in FIG. 3. Alternatively, the identifier sets 19 may be positioned above or below one another on the same body 12.

Figure 5:
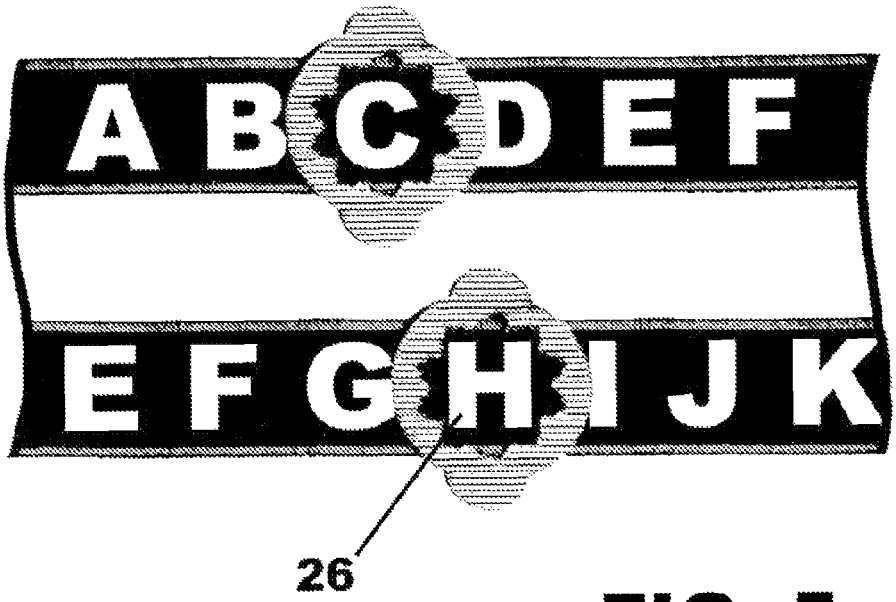
FIG. 5 depicts a view from above of the face side of another one of the preferred embodiments of the present invention, wherein the identifier markers identify individual letters of the alphabet.

Yet in other preferred embodiments the versatile label 10 comprises not only a plurality of identifier sets 19, but also a plurality of label bodies 12. An example of such an embodiment is shown in FIG. 5. In this preferred embodiment, two label bodies 12 are intended to be attached to the garment either one directly above other (as shown in FIG. 5), or in linear succession (as the customer prefers and the size of the garment allows). In this embodiment, each of the bodies 12 has an identifier set 19, identical to an identifier set 19 on another body 12. Namely, each body 12 comprises an identifier set 19 with markers 20 for each of the 26 letters of the alphabet (only portions of the bodies are shown in FIG. 5). In this embodiment at least some (or all) of the plurality of identifier markers 20 identify individual letters of the alphabet.

The embodiment of FIG. 5 is intended to identify characteristics of the product other than size and style. In this case, label 12 may be used to identify the initials of the pants owner. The manufacturer or the consumer may select a proper marker 20 (a letter) from the one body and a proper marker from another body to reflect their first and last name, thus customizing the product. For example, if the jeans' owner's name is "Carlyle Hanson", the label will indicate the maker "C" in the first (top) identifier set 19 and the marker "H" in the second identifier set 19. In such embodiments, labels 10 may be sold with the product, as well as separately from the product and may be configured and attached by the final user.

Such an embodiment, as the one shown in FIG. 5 may be particularly useful for labeling school or gym uniforms for children. In schools that require similar uniforms for all children, articles of clothing often get mixed up (particularly in changing rooms) and taken by others. Garments properly labeled with owner's initials will prevent such incidents. However, many children are reluctant to mark clothing by hand, with a pen or a permanent marker, as such marking effects the value and aesthetic appeal of the garment. The embodiment of label 12 with customizable initials (FIG. 5) will resolve this problem, by allowing for neat and professional-looking labeling of clothes.

The label 10 further comprises at least one selection indicator 22. Preferably the label 10 comprises a selection indicator 22 for each identifier set 19 of markers 20 (that is, for each characteristic identified by the label). The role of the selection indicator 22 is to indicate the selection of a specific marker 20 (or multiple specific markers 20) within each identifier set. FIG. 1 shows 1 selection indicator 22, indicating size "M." The embodiment of FIG. 3 shows the label 10 with two identifier sets 19 (one set for width and one for inseam length). Thus, FIG. 3 shows 2 separate selection indicators 22, with the one on the left indicating the waist width of 25, and the one on the right indicating the inseam length of 30. In preferred embodiments, each body 12 of the label 10 comprises one selection indicator 22, as shown.

It must be noted that in certain embodiments of label 10, there may be more than one selection indicator 22 on any one identifier set 19. For example, in some embodiments, the label, such as the one on FIG. 1 may have 2 selection indicators, one on "M" and one on "L." Such a positioning may indicate a non-standard size in-between medium or large. Alternatively, one selection indicator 22 can be moved to a position in-between two values (markers 20) to indicate non-standard, intermediate size. This is one of the examples, demonstrating the versatility of label 10 in comparison to traditional labels of the prior art.

Yet in other embodiments, it is foreseeable that label 10 will have two (or more) bodies 12 or two (or more) identifier sets 19 and only one selection indicator 22. This may occur in situations where one of the identifier sets 19 is irrelevant to a particular garment (such as an inseam length on a pair of shorts). Alternatively, this may occur where another label is attached to the body 12. For example, the body 12 may be of the type shown on FIG. 1, indicating garment size. Attached to it, may be another body with washing instructions. Naturally, the second body with washing instructions may be universal for all garments of a particular style, and as such, will not need a dedicated selection indicator 22.

In the preferred embodiments of FIGS. 1-4, the selection indicator 22 is a sliding selection indicator, slidably fitted onto (or slidably attached to) the body 12. In the preferred embodiments, the attachment is accomplished through the identifier back loop 24 (back loop 24). Such an attachment allows for movement of the selection indicator 22 along the label body length 12L for selection of one or more of the plurality of the identifier markers 20. It must be noted that once the user or manufacturer slides the selection indicator in place, the preferred embodiments anticipate a way of securing (attaching) the selection indicator in place. In the preferred embodiments this is achieved by applying heat and melting the glue. However, in some non-preferred embodiments it may be advantageous not to secure the marker in place. This may be useful in labeling articles that change their shape and/or characteristics with time.

In the variants illustrated, the selection indicator 22 is a slider made out of a semi-rigid rubberized cloth. In other embodiments, the identifier 22 may be made of soft or rigid materials, such as cloth, paper, rubber, and even metal and plastic, among others. Instead of being of a sliding variety, it may also be glued onto or otherwise attached to or simply drawn on the face side 14. It may be a sticky star or an arrow on the face side 14 of the label body 12.

In the preferred variants, the selection indicator 22 comprises a window 26. The window 26 is positioned over the face side 14 of the body 12. Illustrated embodiments show a cut-out star-shaped window 26 on the front of the selection indicator 22. The window 26 is used for selecting the appropriate identifier on the face side 14 of the body 12. In the preferred embodiments shown, the window 26 is sized to allow at least one of the identifier markers 20 to completely show through the window. In other embodiments, the selection indicator 22 may have an arrow, a strip of clear material, or any other means of indicating a selection, instead of or in addition to a star-shaped cut-out window.

In the preferred embodiments, the back side 16 of the body 12 comprises a layer of heat-sensitive glue 28. The heat-sensitive glue 28 is intended for trapping the selection indicator in place and for attachment of the versatile label 10 to a product intended for labeling. This allows for easy attachment of these embodiments of the label 10 to clothing. In these embodiments, the label 10 can be attached to an article of clothing by sliding or otherwise positioning the selection indicator(s) 22 at the appropriate position(s) on the body 12, positioning the labels 10 at the appropriate position on the article of clothing and sliding a hot iron over the face side 14 to melt the heat-sensitive glue 28 on the back side 16. The glue then attaches the back side 16 to the surface of the article of clothing and locks the selection indicator(s) 22 in place. In this sense, while the selection indicator 22 is slidably attached to the label body 12, it is also fixably attached to the label body 12, as the label 10 comprises the means for permanent fixation of the selection indicator, such as the glue, described here. But of course, numerous other methods of attaching the labels to clothing (including stitching/sewing) are well known to those skilled in the art and may be utilized in attaching the label 10 to a surface and fixating the selection indicator 22 in place.

The versatile label 10 of the present invention also allows for a unique and efficient method of labeling of an article of clothing. The method comprises the first step of obtaining a versatile label 10 of the type described above, and claimed below. The method further requires the step of positioning the selection indicator 22 over at least one identifier marker 20. In the preferred embodiments, this step would require sliding of the selection indicator 22 to indicate one of the values, such as the size of the garment. The third step requires attaching of the versatile label to an article of clothing. As described above, this can be achieved by gluing, sewing, pinning, velcroing, or otherwise affixing the label 10.

The use of the label 10 of the present invention greatly reduces manufacturing costs by removing the need to design and produce multiple varieties of labels for every variation of the product. Instead, one label can be adjusted to fit all varieties of the product. The label of the present invention also provides greater opportunities for artistic expression for designers and manufacturers, and new exciting personalization opportunities for the consumer, among other benefits.

It is to be understood that while the apparatus and method of this invention have been described and illustrated in detail, the above-described embodiments are simply illustrative of the principles of the invention and the forms that the invention can take, and not a definition of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

I claim:

1. A versatile label, comprising at least one label body, wherein each label body of the at least one label body comprises:

a label body width, a label body length, a label body thickness, a face side, a back side, a perimeter edge, at least one identifier set, wherein each identifier set of the at least one identifier set comprises a plurality of identifier markers, said plurality of identifier markers positioned on the face side of the at least one label body;

wherein the at least one label body further comprises at least one selection indicator;

wherein the at least one selection indicator is a sliding selection indicator, said sliding selection indicator being slidingly attached to the label body, allowing for movement along the label body length of the at least one label body for selection of one of the plurality of the identifier markers;

the versatile label further comprising a selection indicator permanent fixator for fixating said sliding selection indicator permanently in place.

2. The versatile label of claim 1, wherein:

the label body thickness is less than ½ of the label body width, and wherein the at least one label body is made out of a flexible material.

3. The versatile label of claim 2, wherein at least some of the plurality of the identifier markers comprise a garment size representation, and wherein each of the at least some of the plurality of the identifier markers that comprise a garment size representation, comprises an entire value of a garment size measurement.

4. The versatile label of claim 3 wherein at least some of the plurality of the identifier markers are stitched onto the face side of the at least one label body.

5. The versatile label of claim 2, wherein the at least one label body is made out of cloth.

6. The versatile label of claim 5, wherein the selection indicator permanent fixator is positioned on the back side of the at least one label body and wherein the selection indicator permanent fixator comprises a layer of heat-sensitive glue, said heat-sensitive glue intended for trapping the selection indicator in place and for attachment of the versatile label to a product intended for labeling.

7. The versatile label of claim 5 wherein the at least one label body comprises an edge stitch line, said edge stitch line positioned along the entire perimeter edge on the face side of the at least one label body.

8. The versatile label of claim 2, wherein the at least one label body comprises a plurality of label bodies, and wherein each label body of the plurality of label bodies comprises one of the at least one selection indicator.

9. The versatile label of claim 8, wherein at least some of the plurality of the identifier markers identify individual letters of the alphabet.

10. The versatile label of claim 2, wherein the at least one label body has the shape of a rectangular strip.

11. The versatile label of claim 1, wherein the selection indicator comprises a window, said window positioned over the face side of the at least one label body;

said window sized to allow the at least one of the plurality of identifier markers to completely show through the window.

12. The versatile label of claim 1, wherein at least one identifier set is a plurality of identifier sets.

13. The versatile label of claim 1, wherein the at least one selection indicator is fixedly attached to the at least one label body.

14. A method of labeling an article of clothing, comprising the steps of:

A. obtaining a versatile label of the type comprising:

at least one label body, wherein each label body of the at least one label body comprises:

a label body width, a label body length, a label body thickness, a face side, a back side, a perimeter edge, at least one identifier set, wherein each identifier set of the at least one identifier sets comprises a plurality of identifier markers, said plurality of identifier markers positioned on the face side of the at least one label body;

wherein the at least one label body further comprises at least one selection indicator;

B. positioning the at least one selection indicator over the at least one identifier marker of the plurality of identifier markers;

C. attaching the versatile label to an article of clothing;

D. fixating said sliding selection indicator permanantly in place over the at least one identifier marker of the plurality of identifier markers.

* * * * *